United States Patent [19]

Kepiro

[11] Patent Number: 4,881,732

[45] Date of Patent: Nov. 21, 1989

[54] EXERCISE DEVICE

[76] Inventor: Joseph Kepiro, 810 Waterfront Dr., Lancaster, Pa. 17602

[21] Appl. No.: 158,649

[22] Filed: Feb. 22, 1988

[51] Int. Cl.[4] ..... A63B 21/00

[52] U.S. Cl. ..... 272/73; 128/25 R; 272/132; 272/DIG. 4

[58] Field of Search ..... 272/73, 131, 132, DIG. 4; 128/25 R, 25 B, 26

[56] References Cited

U.S. PATENT DOCUMENTS

| | | | |
|---|---|---|---|
| 1,820,372 | 8/1931 | Blomquist | 272/73 |
| 2,783,044 | 2/1957 | Sbarra | 272/73 |
| 3,057,201 | 10/1962 | Jaeger | 272/73 |
| 3,964,742 | 6/1976 | Carnielli | 272/73 |
| 4,436,097 | 3/1984 | Cunningham | 272/73 X |
| 4,519,604 | 5/1985 | Arzounian | 272/73 |
| 4,572,501 | 2/1986 | Durham | 272/73 |
| 4,586,706 | 5/1986 | Chen | 272/73 |

FOREIGN PATENT DOCUMENTS

| | | | |
|---|---|---|---|
| 2119 | of 1899 | United Kingdom | 272/73 |

*Primary Examiner*—Richard J. Apley
*Assistant Examiner*—H. Flaxman

[57] ABSTRACT

An exercise device is provided with a frame. Two pedal structures are mounted on the frame. One pedal structure is to be driven by one's legs and the other pedal structure is to be driven by one's arms. A mechanical structure interconnects the two pedals structures so that a force applied to one pedal structure will assist in the movement of the other pedal structure. The pedal structures are interconnected by a gear and clutch structure that transmits a force from one pedal structure to the other pedal structure. An engagable/disengagable gear and clutch structure is provided for each pedal structure so that each pedal structure can be selectively engaged or disengaged.

2 Claims, 6 Drawing Sheets

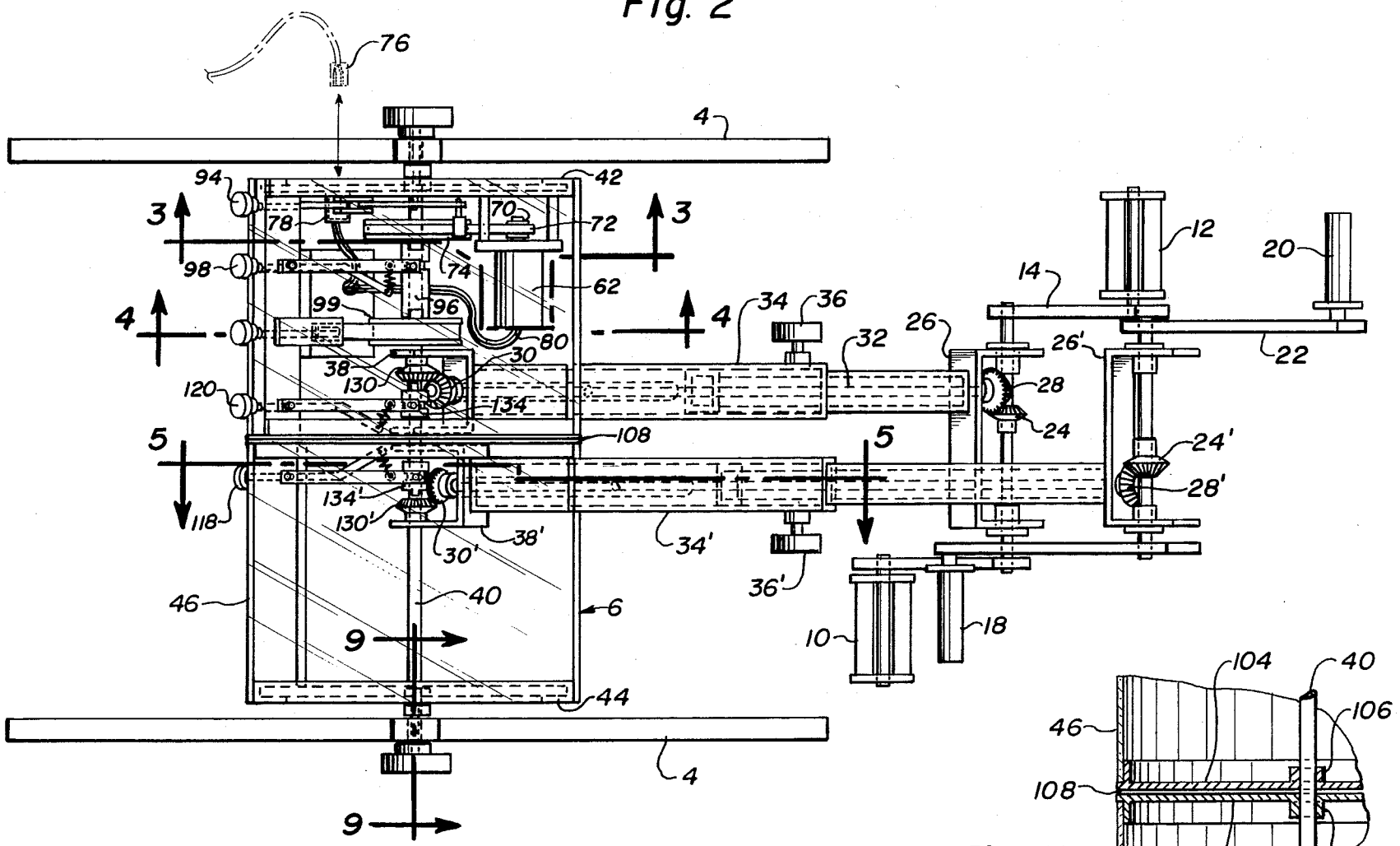
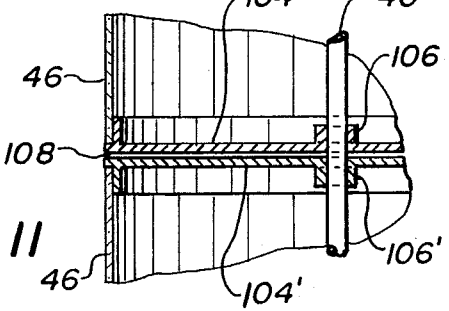
Fig. 11

EXERCISE DEVICE

BACKGROUND OF THE INVENTION

1. Field of the Invention

The invention relates to an exercise device and, more particularly, a device for exercising, at the same time, one's arms and legs.

2. Description of the Prior Art

Many bicycle-type exercisers exist, but are used primarily for the exercise of the muscles of the legs. Some bicycle-type exercisers will provide for the exercise of the arms also, but will not use pedals driven by the arms to assist in the driving of pedals driven by the legs.

SUMMARY OF THE INVENTION

An exercise device is provided with a frame. Two pedal means are mounted on the frame. One pedal means is to be driven by one's legs and the other pedal means is to be driven by one's arms. A mechanical structure interconnects the two pedal means so that a force applied to one pedal means will assist in the movement of the other pedal means. Therefore, one with weak leg muscles can assist in the movement and exercise of the leg muscles by using the arm muscles to assist in the exercise of the leg muscles.

The pedal means are interconnected by a gear and clutch structure that transmits a force from one pedal means to the other pedal means. Each pedal means has two pedal members, one for each limb of the arms or legs. An engagable/disengagable gear and clutch structure is provided for each pedal means so that each pedal means can be selectively engaged or disengaged. The exercise device is primarily for use by one in a wheel chain and has its pedal means arranged for access from a wheel chair.

BRIEF DESCRIPTION OF THE DRAWING

FIG. 2 is a top plan view of the invention;

FIG. 11 is a detail view of the support elements for the center of the drum;

DESCRIPTION OF THE PREFERRED EMBODIMENT

Figure 1:
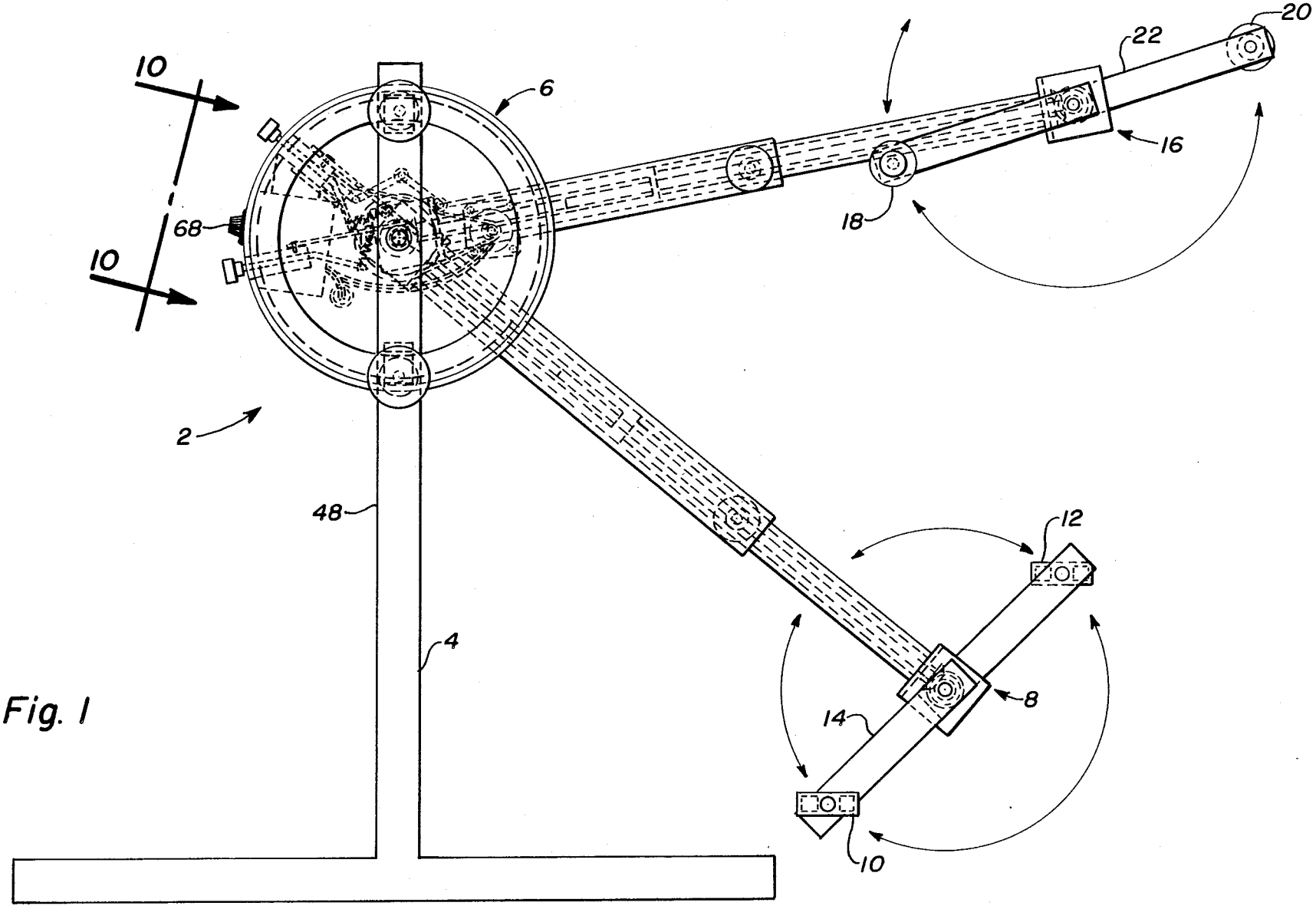
FIG. 1 is a side elevational view of the invention.

In FIG. 1 is shown the exercise device 2 herein. The frame means is two inverted T structures 4 positioned on either side of a drum structure 6. Projecting from the drum structure is the first pedal means 8 adapted to be driven by the legs of one using the exercise device. The pedal means 8 has two pedal members 10, 12 connected together by a bellcrank structure 14. Also projecting from the drug structure is the second pedal means 16 adapted to be driven by the arms of one using the exercise device. The pedal means 16 has two pedal members 18, 20 connected together by a bellcrank structure 22.

Figure 5:
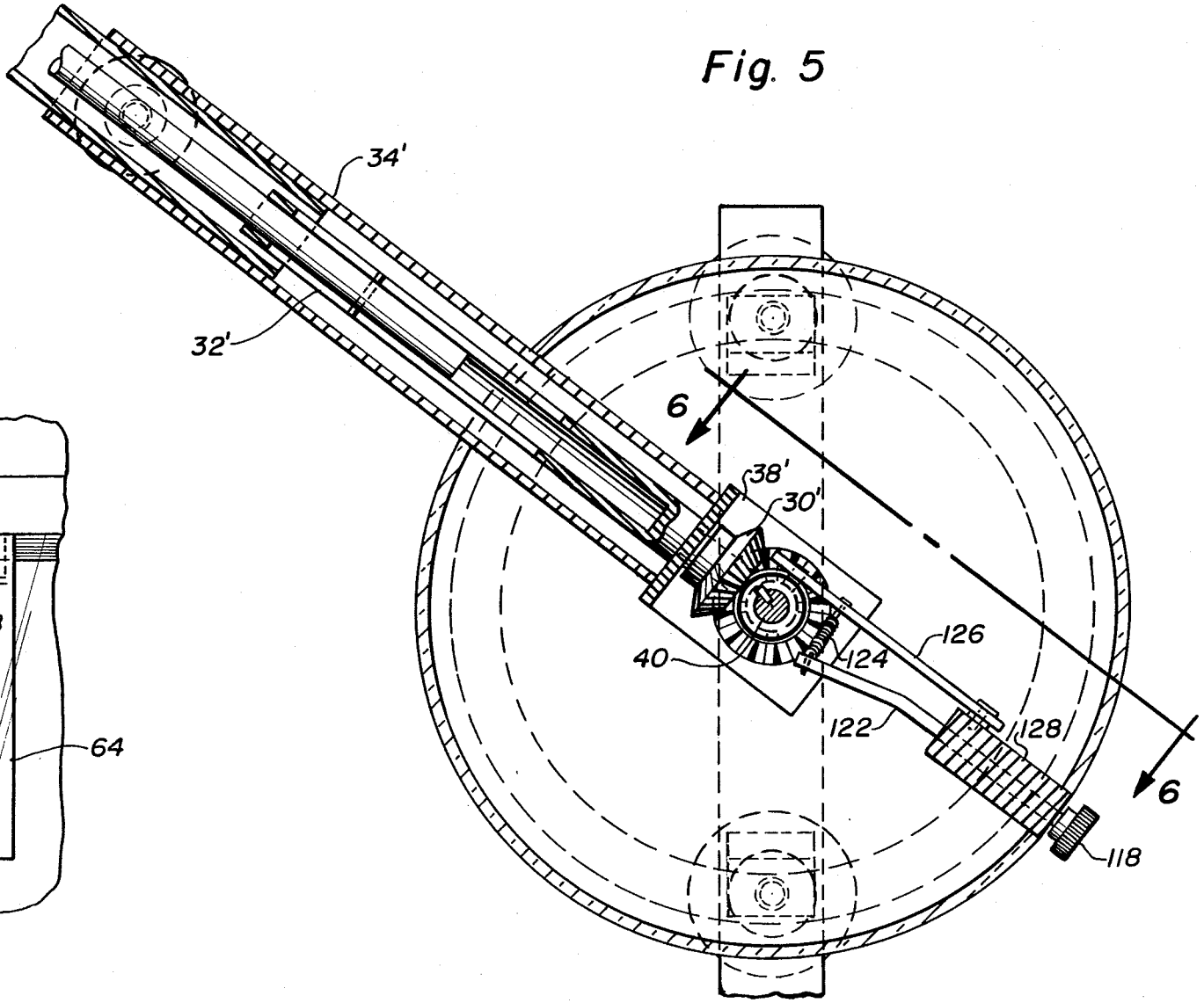
FIG. 5 is a sectional view of the invention taken on the line 5—5 of FIG. 2 (showing the hand pedal housing, the inner end bevel gears and the clutch mechanism therefor)

Referring to FIG. 2 it can be seen that pedal members 10, 12 are like bicycle pedals while pedal members 18, 20 are tubular hand grips. On bellcrank 14 there is a bevel gear 24 affixed thereto to turn as the bellcrank rotates in the yoke 26. Gear 24 engages gear 28 and gear 28 is connected to gear 30 by telescoping shaft 32. As gear 24 turns so too does gear 30. Shaft 32 is in a telescoping housing 34 and screw knob 36 locks together the two sections of the telescoping housing to prevent their movement once the desired length of housing 34 and the position of pedal members 10, 12 are adjusted for the best position for use by the legs of the user of the exercise device. Because of the adjustable feature of the pedal means it is possible for one in a wheel chair, or even a low bed or cot, to use the exercise device. Second pedal means 16 has a bellcrank 22 with gears 24', 28' and 30', yoke 26', shaft 32', housing 34' and knob 36', all working as per the above description for similiar elements connected to bellcrank 14. The elements 22 to 36(') constitute a means transmitting the rotating motion of each pedal means to the rotating motion of a bevel gear, one for each pedal means, within the drum. Connected to housing 34, 34', near gears 30, 30' are yokes 38, 38' respectively. These yokes 38, 38' rotate freely on the axle 40 which passes through the axis of drum 6. In FIG. 5 there is a showing of yoke 38' on axis 40 with the telescoping shaft 32' and telescoping housing 34'.

Figure 9:
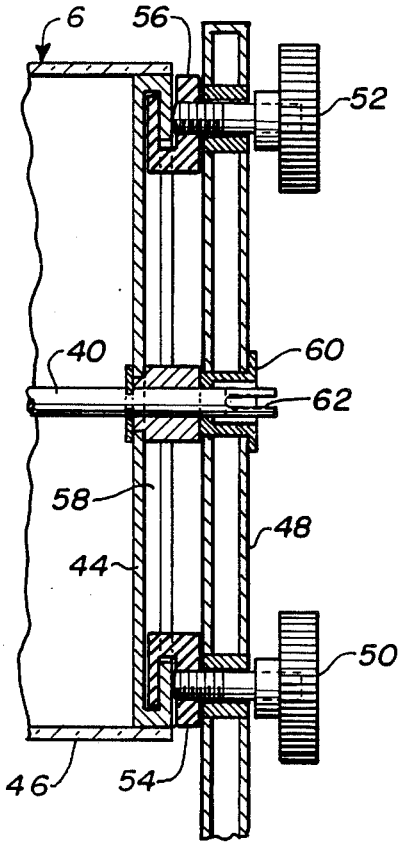
FIG. 9 is a sectional view taken on the line 9—9 of FIG. 2 showing how the drum is clamped and the hand crank socket on the end of the center shaft.

Drum 6 is formed from two end plates 42, 44 and a cylindrical sleeve 46. Sleeve 46 may be a transparent, translucent or opaque material protecting the operating mechanisms within the drum. The mechanisms within the drum cooperate with gears 30, 30' to interconnect the first pedal means 8 and the second pedal means 16. In FIG. 9 can be seen one end of the drum 6. The upright portion 48 of the frame means 4 is shown and the two screw knobs 50, 52 pass through the portion 48 and screw into two C-shaped clamps 54, 56. The end plate 44 of the drum has an exterior groove 58 and one part of the clamps 54, 56 rests in this groove 58. The screw knobs 50, 52 and clamps 54, 56 support the drum on the frame means and the tightening of the knobs 50, 52 prevent the drum from rotating. Loosening the knobs 50, 52 lets the drum rotate and this in turn lets the housing 34, 34' with pedal means 8 and 16 swing in a wide arc either side of the frame means. This movement of the pedal means, in an arc, along with the telescoping housings, permits the pedal means to be adjusted to users in a wheel chair, low cot, etc. for use thereby. As can be seen in FIG. 9, the axle 40 is supported in bearing 60 and a like structure supports the other end of axle 40 on the frame member 4. The end of the axle 40 has a slot 62 which can be used to rotate the axle by hand. The right and left halves of the drum 6 can be rotated separately. Two side by side elements 104, 104' support the sleeve 46 at the center of the drum 6. The sleeve 46 is cut at elements 104, 104' so that the sleeve is in two parts. One half of the sleeve 46 is supported on end plate 42 and element 104 and the other half of sleeve 46 is supported on end plate 44 and element 104'. This permits each half of the drum and its pedal means to rotate separately. FIG. 11 shows the elements 104, 104' supported on bearings 106, 106' mounted on axle 40. Sleeve 46 is cut at point 108 so that the two halves of the drum can rotate separately with their pedal means 8 or 16.

Figure 3:
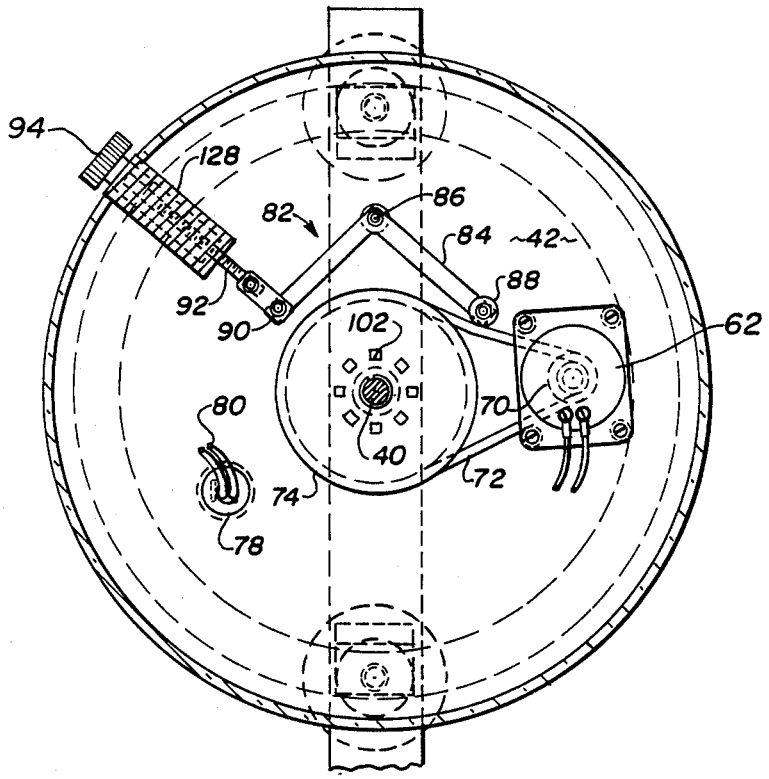
FIG. 3 is a sectional view of the invention taken on the line 3—3 of FIG. 2 (showing the motor, drive belt, drive pulley and belt tightening mechanism.
Figure 10:
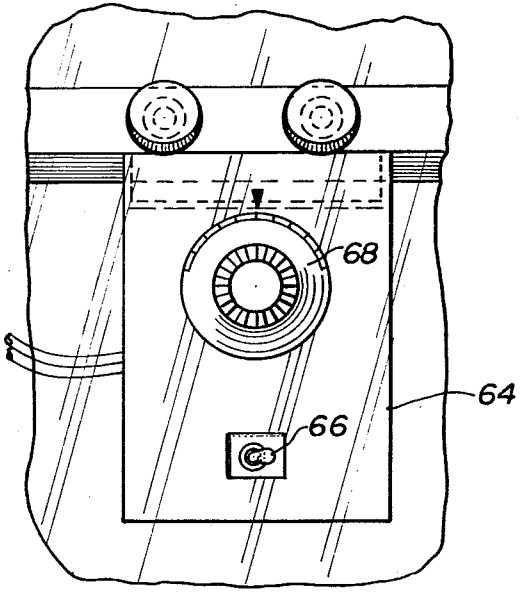
FIG. 10 is a detail view of a portion of the outside of the drum showing the motor control box with the variable speed knob and direction reversing switch.

Referring now to FIG. 3 there can be seen a motor means 62, mounted on each plate 42, used to apply a force to the axle 40. The motor is controlled by the control box 64 of FIG. 10. The box 64 is within the drum 6, but a reversing switch 66 and variable speed knob 68 project outside the drum. When the motor 62 is being used, the reversing switch can vary the rotational direction the force is applied to the axle, as explained below. The reversing switch has an off position to shut off the motor. When the motor 62 is on, it drives motor pulley 70, belt 72 and axle shaft pulley 74. The axle shaft pulley is freely rotatable on the axle 40 and rotation of the pulley 74, driven by the motor, can provide a force to rotate axle 40. The variable speed knob 68 controls the speed of the motor and, therefore, the force the motor applies to the axle. The power for the motor comes from outside wiring 76, a receptacle 78 and inside drum wiring 80, best shown in FIG. 2. A belt tightening mechanism 82 is used to insure a positive power transmission from pulley 70 to pulley 74 without belt slippage. An angled lever 84 is pivoted on a post 86 and has an one end thereof a roller 88 engaging the belt 72 to keep tension thereon. The other end 90 of the lever 84 is connected by a link to a threaded rod 92. The rod is threaded to the knob 94, on the outside of the drum, so, by rotation of the knob 94, the threaded rod 92 can move axially to move end 90 and, therefore, roller 88. Tensioning of the belt 72 with knob 94 is primarily to prevent belt slippage under load.

The engagement of the pulley 74 with the axle 40 is secured by a clutch 96 controlled by knob 98. Selective engagement of the clutch 96 with the pulley 74 can result in the motor applying a force to the axle 40. The clutch 96 is keyed to the axle 40 and turns with the axle, but has limited sliding movement along the axis of the axle 40. The clutch is positioned between the pulley 74 and a pulley 99 of the resistance applying means of FIG. 4 to be described below. Each end of the clutch 96 has a series of projections or teeth spaced around the perimeter of the end of the clutch. The arrangement of the teeth 100 can best be seen in FIG. 6 which is a showing of another clutch mechanism used in the exercise device. All clutches herein use a similar tooth arrangement to have the clutch positively engage a pulley or gear. The teeth on the clutch 96 engage the recesses 102 spaced around the center bore of the pulley 74 as seen in FIG. 3. With the teeth 100 in the recesses 102, the pulley 74 will apply a force to axle 40. Turning the knob 98 one way will slide the clutch 96 away from engagement with pulley 74. The clutch slides out of engagement with pulley 74 and pops into engagement with pulley 99. Turning the knob 98 in the opposite direction causes the clutch teeth on one end of the clutch to disengage from recesses in pulley 99 and teeth on the other end of the clutch to pop into engagement with the recesses 102 of pulley 74. Careful movement of knob 98 will cause the clutch 96 to disengage from either pulley 74 or 99 and rest in a neutral position engaging neither pulley 74 or 99. The mechanism which permits knob 98 to move the clutch will be explained in the description of FIGS. 6 and 7 below. the knob has a neutral position in which clutch 96 engages neither pulley 74 or 99.

Figure 4:
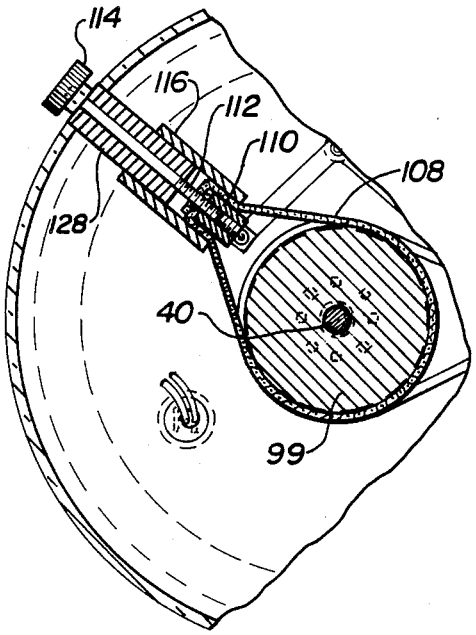
FIG. 4 is a sectional view of the invention taken on the line 4—4 of FIG. 2 (showing the center shaft drag brake mechanism)
Figure 7:
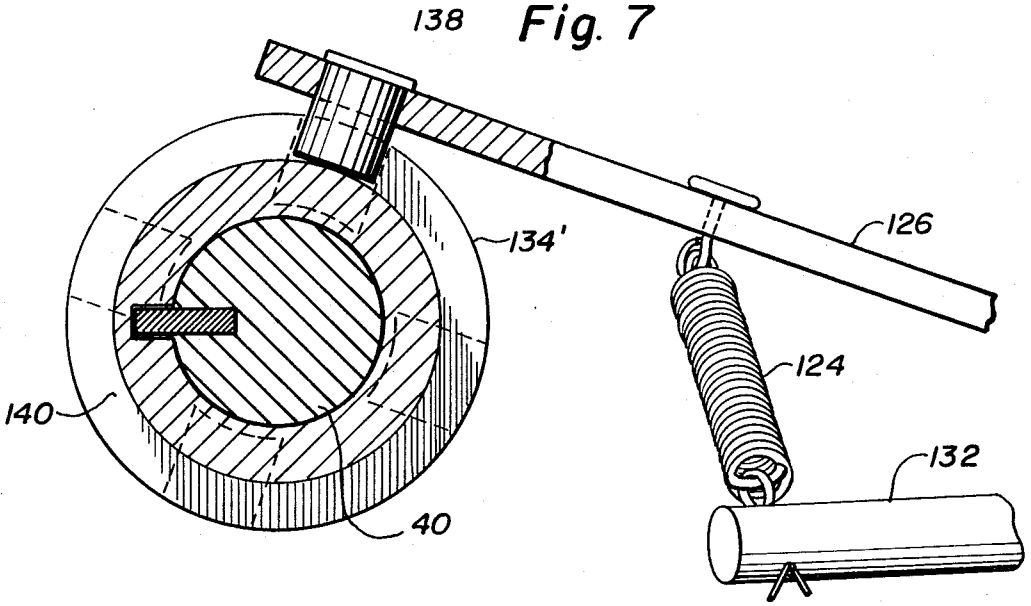
FIG. 7 is an enlarged detail sectional view taken on the line 7—7 of FIG. 6.
Figure 6:
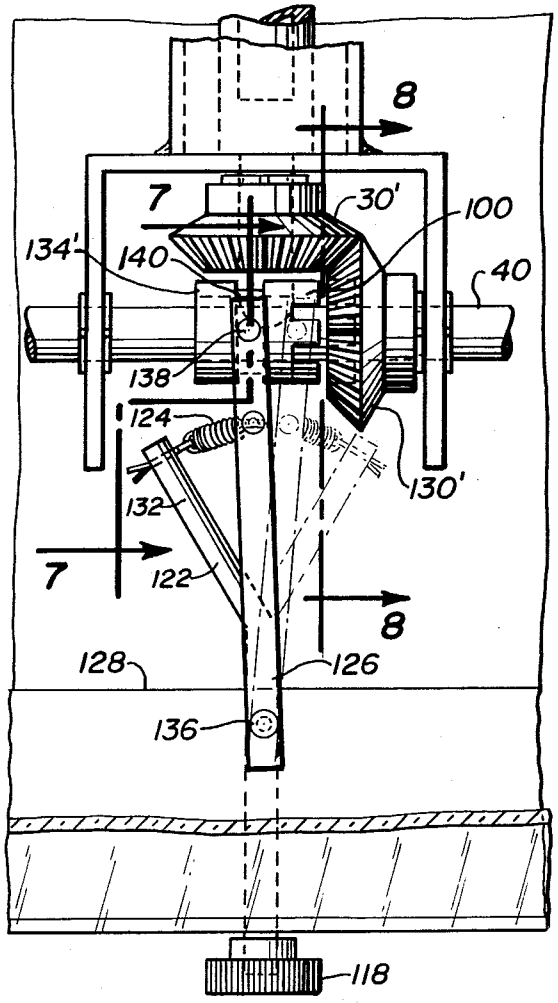
FIG. 6 is a fragmentary top plan view of the mechanism of FIG. 5, as seen from the line 6—6 of FIG. 5 (the clutch mechanism is shown in the solid lines in the disengaged position and shown in phantom lines in the engaged position)

Referring to FIG. 4 there is shown the resistance applying means provided to vary the resistance to the turning of the pedal means. A pulley 99 is mounted on axle 40 to freely rotate thereon. A friction belt 108 is wrapped around the circumference of pulley 99 and the ends of the belt are held on a retainer 110 fastened to a threaded rod 112 with a knob 114 on the outside of the drum. The rod 112 passes through a housing 116 that receives the belt ends and retainer 110 in the inner end thereof. Turning of the knob 114 in one direction draws the retainer 110 and belt ends within the housing 116 toward the knob 114 to increase the frictional contact of the belt on pulley 99. Turning the knob in the opposite direction moves the retainer 110 away from knob 114 and lessens the frictional contact of the belt on pulley 99 to lessen the resistance applied to the turning of the pedal means. The side of the pulley 99 facing pulley 74 and clutch 96 has recesses 102 therein the same as pulley 74 shown in FIG. 3. The teeth 100 on the end of the clutch 96 facing pulley 99 will engage the recesses 102 of pulley 99. When the teeth 100 and recesses 102 are engaged, the resistance of belt 108 on pulley 99 is transmitted to clutch 96 and axle 40 to which clutch 96 is keyed. This provides variable resistance to the movement of the pedal means.

the mechanism that causes knob 98 to move clutch 96, and also knobs 118 and 120 to move the clutch adjacent bevel gears 30 and 30', is shown in FIGS. 5, 6 and 7. In FIG. 5 there is shown knob 118 connected to rod 122. The end of the rod 122 connected to knob 118 passes through a housing 128 that acts as a bearing for rod 122 to permit the knob end of the rod to rotate. The end of the rod 122, opposite from the knob end of the rod, is bent at an angle to the axis of the knob end of the rod, as best shown in FIG. 5. The movement of the bent end of the rod 122, when knob 118 is rotated, is best seen in FIG. 6. Knob 118, and knobs 98 and 120, have limited clockwise and counterclockwise movement to move their clutchs back and forth on axle 40.

Figure 8:
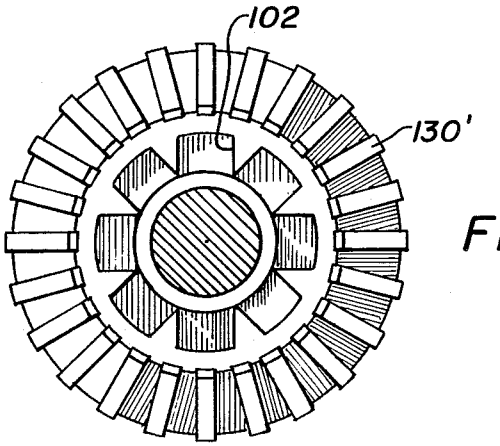
FIG. 8 is an enlarged detail sectional view taken on the line 8—8 of FIG. 6 showing the clutch tooth receiving formations in the face of the bevel gear.

Referring to FIG. 6, the clutch 134' is shown in its disengaged position with the rod 122 and bar 126 shown in solid liens and, when the clutch is in its engaged position, the rod 122 and bar 126 are shown in phantom lines. FIG. 6 shows the bevel gear and clutch arrangement for pedal means 16 and the same bevel gear and clutch arrangement is used for pedal means 8. Bevel gear 30' is caused to rotate by pedal means 16 as explained above. Gear 30' engages bevel gear 130' and, when gear 30' rotates, gear 130' rotates. Gear 130' is mounted to freely rotate on axle 40. Clutch 134' is keyed to axle 40 and has limited sliding movement along the axle 40. When the teeth on clutch 134' engage the recesses 102 in bevel gear 130' (shown in FIG. 8), movement of pedal means 16 goes from gear 24' to gear 28' to gear 30' to gear 130' to clutch 134' to axle 40. Similiar gears 24, 28, 30, 130 and clutch 134 connect pedal means 8 to axle 40.

The bent end 132 of rod 122 will move from the left side of clutch 134' (solid line position of FIG. 6) to the right side of clutch 134' (phantom line position of FIG.

6) when the knob 118 and knob end of rod 122 are rotated. The bent end 132 of rod 122 can be seen on either the left or right side of bar 126 in FIG. 6. Because the spring 124 is connected to both bar 126 and rod end 132 (as shown in FIG. 7), movement of the rod end from left to right in FIG. 6 will move the bar from left (solid line) to right (phantom line). The end of the bar away from the clutch 134' is pivotted at point 136 to housing 128. The end of the bar 126 by clutch 134' can then move from the left to right as the rod end 132 moves from the left to right. Right/left movement of the rod end causes right/left movement of the bar. The end of bar 126 by clutch 134' has a post 138 that rests in a groove 140 in clutch 134'. As the end of the bar 126 moves left to right the post 138 in groove 140 forces the clutch into engagement with bevel gear 130'. Movement of bar right to left disengages clutch 134' and gear 130'.

It can be seen from the above description of the invention herein that axle 40 can connect together the two pedal means so that force applied to one pedal means can be transferred to the other pedal means. Also a driving force from a motor or a resistance from a brake like element can be applied to axle 40 and thereby to the pedal means.

Figures 12, 13:
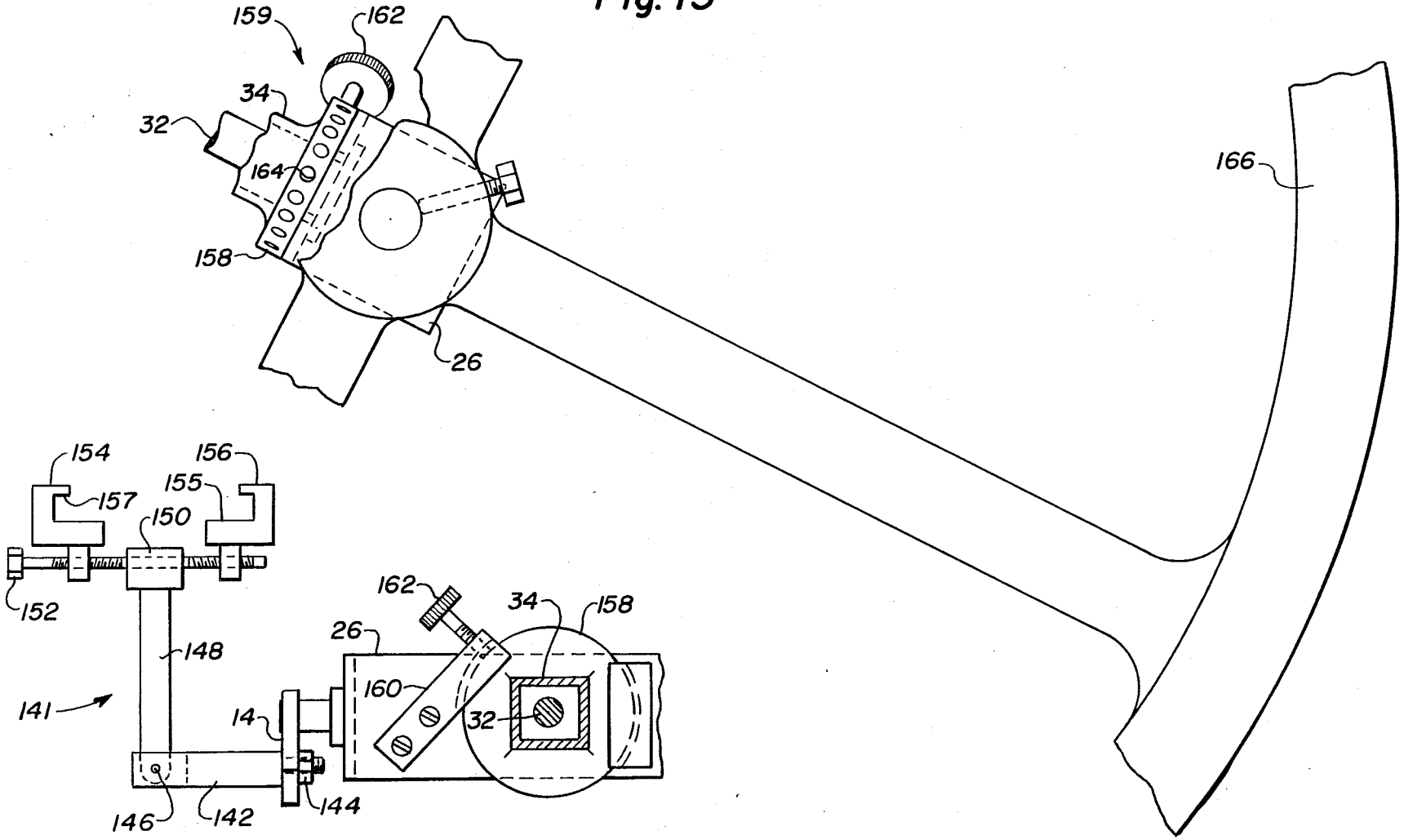
FIG. 12 is a modification of the foot pedal means.
FIG. 13 is a modification of the hand pedal means.

FIG. 12 shows a modification for pedal members 10, 12 wherein the pedal member 141 replaces pedal member 10 or 12. A rod 142 is screwed into the recess of the bellcrank 14 formerly holding a pedal member 10 or 12. A lock nut 144 holds rod 142 in place. A rod 148 is pivotally connected to rod 142 at one end thereof. On the opposite end of rod 148 is connected a shoe clamp with a fastening screw 152 positioned in a holder 150 and two shoe sole clamps 154 and 156. Turning of the screw 152 will hold the bottom of a shoe sole against surface 155 and hook the side and upper edge of the shoe sole with hooks 157. One can fasten the pedal member 141, similar to a roller skate clamp, to one's shoe and turn the bellcrank, particularly while standing. In FIG. 13 is another modification wherein the hand operated crank has the hand grips 18 or 20 replaced with a steering wheel 166 to exercise the arms. The wheel 166 is connected directly to the part of the bellcrank having the gear 24' thereon.

Finally, FIGS. 12 and 13 show a means to permit the pedal means 8 and 16 to rotate about the axis of housing 34 or 34'. A collar 158 is fastened to housing 34. Yoke 26 can rotate around the colar 158 and is held to the collar by bar 160 fastened to the yoke. A thumb screw 162 is positioned in recesses 164 of the collar to prevent movement of the yoke and collar relative to each other. The means 159 permits the pedal means to rotate about the housing 34 or 34' to permit the pedal means to move 360 degrees in a plane perpendicular to the axis of the housing.

What is claimed is:

1. An exercise device comprising:

(a) a frame means for supporting the structure that will be used for exercising the muscles of the arms and legs;

(b) a first pedal means adapted to be driven by the legs of one using the exercise device;

(c) a second pedal means adapted to be driven by the arms of one using the exercise device;

(d) both said first and second pedal means being mounted on the frame means;

(e) means interconnecting said first pedal means and said second pedal means so that a force applied to one pedal means will assist in the movement of the other pedal means;

(f) said means interconnecting said pedal means is within the perimeter surface and ends of a drum supported on the frame means, said first and second pedal means each being on the end of their individual support structures extending from the drum, means transmitting the rotating motion of each pedal means to the rotating motion of bevel gears on a common axle, one bevel gear for each pedal means, within the perimeter surface and ends of said drum;

(g) clutch means on said common axle selectively engaging none, one or both of the bevel gears of the two pedal means whereby when the clutch means engage said gears, the force applied to either of the pedal means is transmitted to the other pedal means; and (h) said clutch means is composed of two clutch structures keyed to the common axle and slidable therealong, means moving each clutch structure selectively into and out of engagement with each of said bevel gears for each pedal means.

2. The exercise device of claim 1 wherein said drum is formed of two halves that rotate separately, the first pedal means extends from one drum half and rotates therewith, the second pedal means extends from the other drum half and rotates therewith.

* * * * *